US006721530B2

(12) United States Patent
Hirst et al.

(10) Patent No.: US 6,721,530 B2
(45) Date of Patent: Apr. 13, 2004

(54) FUSING SYSTEM HAVING ELECTROMAGNETIC HEATING

(75) Inventors: B. Mark Hirst, Boise, ID (US); Mark Wibbels, Boise, ID (US); Kenneth E. Heath, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/819,443

(22) Filed: Mar. 28, 2001

(65) Prior Publication Data

US 2002/0141794 A1 Oct. 3, 2002

(51) Int. Cl.[7] ..... G03G 15/20

(52) U.S. Cl. ..... 399/328; 219/619; 219/636; 399/336

(58) Field of Search ..... 399/328, 330, 399/335, 336; 219/216, 619, 635, 636

(56) References Cited

U.S. PATENT DOCUMENTS

| | | | | | |
|---|---|---|---|---|---|
| 3,951,835 | A | * | 4/1976 | Tomono et al. | |
| 4,905,050 | A | | 2/1990 | Derimiggio et al. | |
| 5,450,183 | A | * | 9/1995 | O'Leary | 399/328 |
| 5,778,293 | A | * | 7/1998 | Ohtsuka | 219/216 |
| 5,789,723 | A | | 8/1998 | Hirst | 219/501 |
| 5,837,340 | A | * | 11/1998 | Law et al. | 219/216 |
| 5,839,043 | A | | 11/1998 | Okabayashi et al. | 399/329 |
| 5,862,435 | A | * | 1/1999 | Suzumi et al. | |
| 5,940,655 | A | * | 8/1999 | Sano et al. | 399/328 |
| 5,945,223 | A | * | 8/1999 | Kuntz et al. | 399/330 |
| 5,984,848 | A | | 11/1999 | Hyllberg et al. | 492/46 |
| 5,999,787 | A | * | 12/1999 | Finsterwalder et al. | 219/216 |
| 6,018,151 | A | | 1/2000 | Hirst | 219/497 |
| 6,021,303 | A | | 2/2000 | Terada et al. | 399/328 |
| 6,026,273 | A | * | 2/2000 | Kinouchi et al. | 399/328 |
| 6,069,347 | A | * | 5/2000 | Genji et al. | 399/330 |
| 6,078,781 | A | * | 6/2000 | Takagi et al. | 219/619 |
| 6,122,478 | A | | 9/2000 | Hirst | 399/330 |
| 6,181,891 | B1 | | 1/2001 | Higashi et al. | 399/70 |
| 6,292,648 | B1 | * | 9/2001 | Higaya et al. | 219/216 |
| 6,304,740 | B1 | | 10/2001 | Ciaschi et al. | 399/328 |
| 6,377,775 | B1 | * | 4/2002 | Nakayama et al. | 399/328 |
| 6,505,027 | B2 | * | 1/2003 | Takeuchi et al. | 399/328 |
| 6,512,913 | B2 | * | 1/2003 | Hirst et al. | 399/328 |
| 2002/0007752 | A1 | * | 1/2002 | Sakagami | |

FOREIGN PATENT DOCUMENTS

| | | | |
|---|---|---|---|
| JP | 7-295414 | * | 11/1995 |
| JP | 8-69190 | * | 3/1996 |
| JP | 8-87191 | * | 4/1996 |
| JP | 10-97150 | * | 4/1998 |
| JP | 10-333491 | * | 12/1998 |
| JP | 11-297462 | * | 10/1999 |
| JP | 2000-187406 | * | 7/2000 |
| JP | 2000-214713 | * | 8/2000 |
| JP | 2000-214714 | * | 8/2000 |
| JP | 2000-235329 | * | 8/2000 |

* cited by examiner

*Primary Examiner*—Susan S. Y. Lee

(57) ABSTRACT

The present disclosure relates to a fusing system for fusing toner to a recording medium. The fusing system includes a fuser roller including a metal layer, a pressure roller in contact with the fuser roller, and an external induction heating element. In addition, the disclosure relates to a method for heating a fuser roller of a fusing system including the steps of positioning an external induction heating element in close proximity to the outer surface of the fuser roller, delivering high frequency current to a coil of the external induction heating element to create a magnetic flux, and directing the magnetic flux toward the fuser roller so as to induce eddy currents within a metal layer of the fuser roller that generate heat within the roller.

11 Claims, 6 Drawing Sheets

FUSING SYSTEM HAVING ELECTROMAGNETIC HEATING

FIELD OF THE INVENTION

The present disclosure relates to a fusing system. More particularly, the disclosure relates to a fusing system having external electromagnetic induction heating.

BACKGROUND OF THE INVENTION

Electrophotographic printing and copying devices typically are provided with fusing systems that serve to thermally fuse a toner image onto a recording medium, such as a sheet of paper. Such fusing systems normally comprise a heated fuser roller and a heated pressure roller that presses against the fuser roller to form a nip in which the fusing occurs. The fuser and pressure rollers often comprise hollow tubes coated with thick layers of high temperature rubber. The hollow rollers enclose internal heat sources that uniformly irradiate the inner surfaces of the rollers. Through this irradiation, the inner surfaces are heated and this heat diffuses to the outer surfaces of the fuser and pressure rollers until they reach a temperature sufficient to melt the toner (e.g., approximately between 160° C. to 190° C.).

The fuser roller and the pressure roller rotate in opposite directions and are urged together so as to form a nip that compresses the outer high temperature rubber layers of the rollers. The compression of these layers increases the width of the nip, which increases the time that the recording medium resides in the nip. The longer the dwell time in the nip, the larger the total energy that the toner and recording medium can absorb to melt the toner. Within the nip, the toner is melted and fused to the medium by the pressure exerted on it by the two rollers. After the toner has been fused, the recording medium is typically forwarded to a discharge roller that conveys the medium to a discharge tray.

In the fusing system described above, a tungsten filament halogen lamp or thin film heater is typically used as the heat source. Unfortunately, the high thermal mass of the rollers and the high thermal resistance of the outer rubber layers of the rollers require a relatively long duration of time to reach operating temperature. Therefore, a user of the printing, copying, or facsimile device can be prevented from quickly utilizing the device. Although the rate that energy is applied to the fusing rollers can be increased, there are practical limits to the power available from a 120 volt, 15 or 20 ampere branch circuit.

In recent years, there has been a drive toward reducing warm-up time without increasing energy use. To that end, fusing systems have been proposed that utilize induction heating. These systems typically comprise an induction heating element that is disposed inside a hollow fuser roller constructed of a thin metal tube. In such systems, the coil of the induction heating element is placed in close proximity with the inner surface of the fuser roller to generate a high frequency magnetic field that induces eddy currents within the roller that, in turn, create heat.

Induction heating in this manner provides several advantages over more conventional heating methods. First, induction heating quickly elevates the temperature of the low thermal mass of the thin metal fuser roller yet generates heat only sparingly as compared with indirect heating with a halogen lamp. Second, induction heating apparatuses have greater useful lives in that sliding contact is not required between the coil and the inner surface of the fuser roller as is required of thin film heaters. Third, induction heating provides greater control over temperature because the reduced thermal mass and decreased transport lag allows the system to respond more quickly to thermal loads.

Although use of induction heating provides the advantages described above, there are disadvantages associated with present fusing system designs that incorporate induction heating. Most particularly, placement of the induction heating element within the fuser roller increases the total cost of ownership of the machine. First, current designs increase manufacturing costs in that inclusion of an induction heating element within the fuser roller greatly increases the complexity of the fuser roller design. Second, inclusion of the induction heating element within the fuser roller increases machine maintenance costs in that as is known in the art, conventional fusing systems must be periodically replaced due to failure of the outer surfaces of the rollers. With current designs, the induction heating element contained within the fuser roller and its associated temperature sensor and electrical connectors are discarded along with the fuser roller because of their integration with the roller. In that these components are expensive, it is wasteful to discard them in this manner, particularly because these components have a very low failure rate and normally would last the entire useful life of the print/copy engine.

From the foregoing, it can be appreciated that it would be desirable to have a fusing system that uses electromagnetic heating but which is less costly to manufacture and which comprises a permanent part of the machine in which is used.

SUMMARY OF THE INVENTION

The present disclosure relates to a fusing system for fusing toner to a recording medium. The fusing system comprises a fuser roller including a metal layer, a pressure roller in contact with the fuser roller, and an external induction heating element.

In addition, the disclosure relates to a method for heating a fuser roller of a fusing system. The method can be summarized by the following steps: positioning an external induction heating element in close proximity to the outer surface of the fuser roller, delivering high frequency current to a coil of the external induction heating element to create a magnetic flux, and directing the magnetic flux toward the fuser roller so as to induce eddy currents within a metal layer of the fuser roller that generate heat within the roller.

The features and advantages of the invention will become apparent upon reading the following specification, when taken in conjunction with the accompanying drawings.

BRIEF DESCRIPTION OF THE DRAWINGS

The invention can be better understood with reference to the following drawings. The components in the drawings are not necessarily to scale, emphasis instead being placed upon clearly illustrating the principles of the present invention.

DETAILED DESCRIPTION

Figure 1:
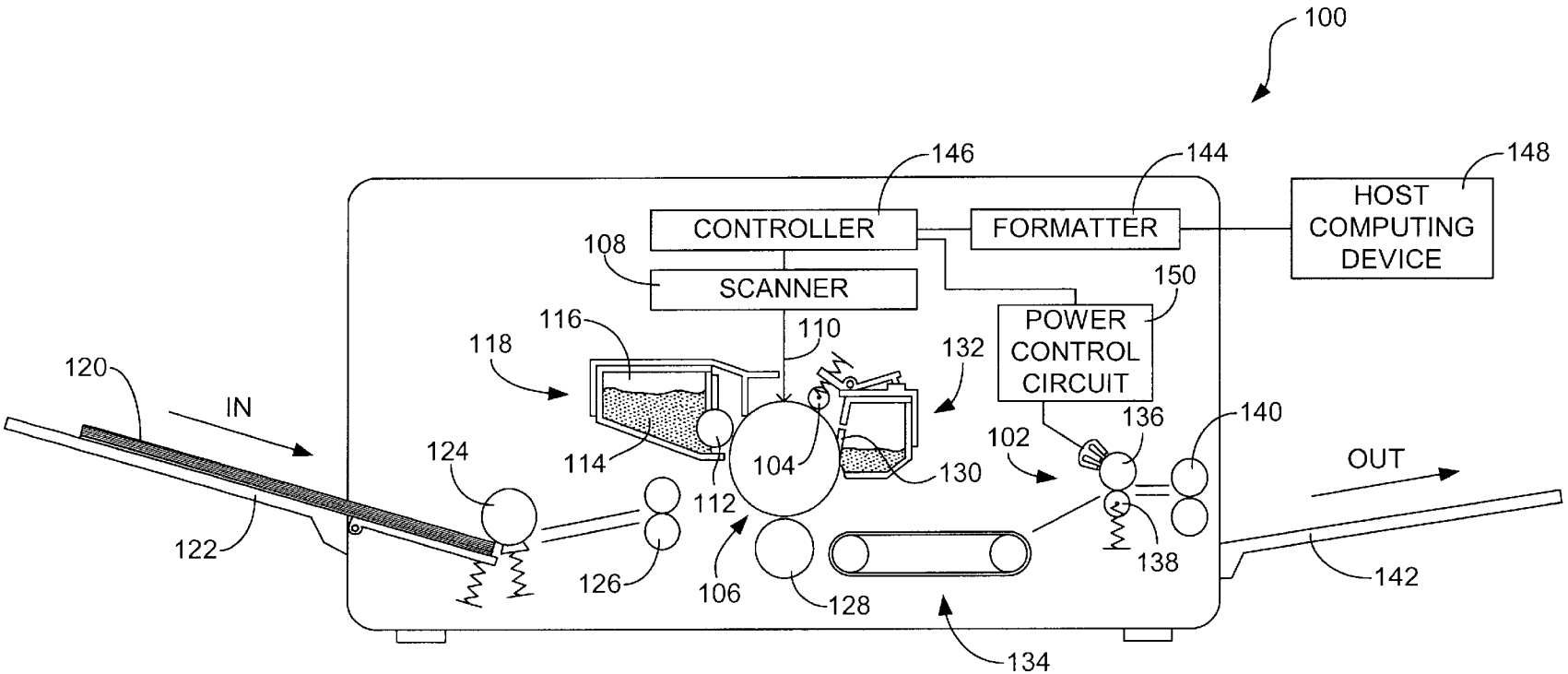
FIG. 1 is a schematic side view of an electrophotographic imaging device incorporating a first fusing system.

Referring now in more detail to the drawings, in which like numerals indicate corresponding parts throughout the several views, FIG. 1 illustrates a schematic side view of an electrophotographic imaging device 100 that incorporates a first fusing system 102. By way of example, the device 100 comprises a laser printer. It is to be understood, however, that the device 100 can, alternatively, comprise any other such imaging device that uses a fusing system including, for instance, a photocopier or a facsimile machine.

As indicated in FIG. 1, the device 100 includes a charge roller 104 that is used to charge the surface of a photoconductor drum 106, to a predetermined voltage. A laser diode (not shown) is provided within a laser scanner 108 that emits a laser beam 110 which is pulsed on and off as it is swept across the surface of the photoconductor drum 106 to selectively discharge the surface of the photoconductor drum. In the orientation shown in FIG. 1, the photoconductor drum 106 rotates in the counterclockwise direction. A developing roller 112 is used to develop a latent electrostatic image residing on the surface of photoconductor drum 106 after the surface voltage of the photoconductor drum has been selectively discharged. Toner 114 is stored in a toner reservoir 116 of an electrophotographic print cartridge 118. The developing roller 112 includes an internal magnet (not shown) that magnetically attracts the toner 114 from the print cartridge 118 to the surface of the developing roller. As the developing roller 112 rotates (clockwise in FIG. 1), the toner 114 is attracted to the surface of the developing roller 112 and is then transferred across the gap between the surface of the photoconductor drum 106 and the surface of the developing roller to develop the latent electrostatic image.

Recording media 120, for instance sheets of paper, are loaded from an input tray 122 by a pickup roller 124 into a conveyance path of the device 100. Each recording medium 120 is individually drawn through the device 100 along the conveyance path by drive rollers 126 such that the leading edge of each recording medium is synchronized with the rotation of the region on the surface of the photoconductor drum 106 that comprises the latent electrostatic image. As the photoconductor drum 106 rotates, the toner adhered to the discharged areas of the drum contacts the recording medium 120, which has been charged by a transfer roller 128, such that the medium attracts the toner particles away from the surface of the photoconductor drum and onto the surface of the medium. Typically, the transfer of toner particles from the surface of the photoconductor drum 106 to the surface of the recording medium 120 is not completely efficient. Therefore, some toner particles remain on the surface of the photoconductor drum. As the photoconductor drum 106 continues to rotate, the toner particles that remain adhered to the drum's surface are removed by a cleaning blade 130 and deposited in a toner waste hopper 132.

As the recording medium 120 moves along the conveyance path past the photoconductor drum 106, a conveyer 134 delivers the recording medium to the fuser system 102. The recording medium 120 passes between a fuser roller 136 and a pressure roller 138 of the fusing system 102 that are described in greater detail below. As the pressure roller 138 rotates, the fuser roller 136 is rotated and the recording medium 120 is pulled between the rollers. The heat applied to the recording medium 120 by the fusing system 102 fuses the toner to the surface of the recording medium. Finally, output rollers 140 draw the recording medium 120 out of the fusing system 102 and delivers it to an output tray 142.

As identified in FIG. 1, the device 100 can further include a formatter 144 and a controller 146. The formatter 144 receives print data, such as a display list, vector graphics, or raster print data, from a print driver operating in conjunction with an application program of a separate host computing device 148. The formatter 144 converts the print data into a stream of binary print data and sends it to the controller 146. In addition, the formatter 144 and the controller 146 exchange data necessary for controlling the electrophotographic imaging process. In particular, the controller 146 supplies the stream of binary print data to the laser scanner 108. The binary print data stream sent to the laser diode within the laser scanner 108 pulses the laser diode to create the latent electrostatic image on the photoconductor drum 106.

In addition to providing the binary print data stream to the laser scanner 108, the controller 146 controls a high voltage power supply (not shown) that supplies voltages and currents to the components used in the device 100 including the charge roller 104, the developing roller 112, and the transfer roller 128. The controller 146 further controls a drive motor (not shown) that drives the printer gear train (not shown) as well as the various clutches and feed rollers (not shown) necessary to move recording media 120 through the conveyance path of the device 100.

A power control circuit 150 controls the application of power to the fusing system 102. In a preferred arrangement, the power control circuit 150 is configured in the manner described in U.S. Pat. Nos. 5,789,723 and 6,018,151, which are hereby incorporated by reference into the present disclosure, such that the power to the fusing system 102 is linearly controlled and the power levels can be smoothly ramped up and down as needed. As described in these patents, such operation provides for better control over the amount of heat generated by the fusing system 102. While the device 100 is waiting to begin processing a print or copying job, the temperature of the fuser roller 136 is kept at a standby temperature corresponding to a standby mode. In the standby mode, power is supplied at a reduced level to the fuser roller 136 by the power control circuit 150 to reduce power consumption, lower the temperature, and reduce the degradation resulting from continued exposure to the components of the fusing system 102 to the fusing temperatures.

The standby temperature of the fuser roller 136 is selected to balance a reduction in component degradation against the time required to heat the fuser roller from the standby temperature to the fusing temperature. From the standby temperature, the fuser roller 136 can be quickly heated to the temperature necessary to fuse toner to the recording media 120. When processing of a fusing job begins, the controller 146, sufficiently ahead of the arrival of a recording medium 120 at the fusing system 102, increases the power supplied by the power control circuit 150 to the fusing system to bring its temperature up to the fusing temperature. After completion of the fusing job, the controller 146 sets the power control circuit 150 to reduce the power supplied to the fusing system to a level corresponding to the standby mode. The cycling of the power supplied to fusing system 102 is ongoing during the operation of device as fusing jobs are received and processed and while the device is idle.

Figure 2:
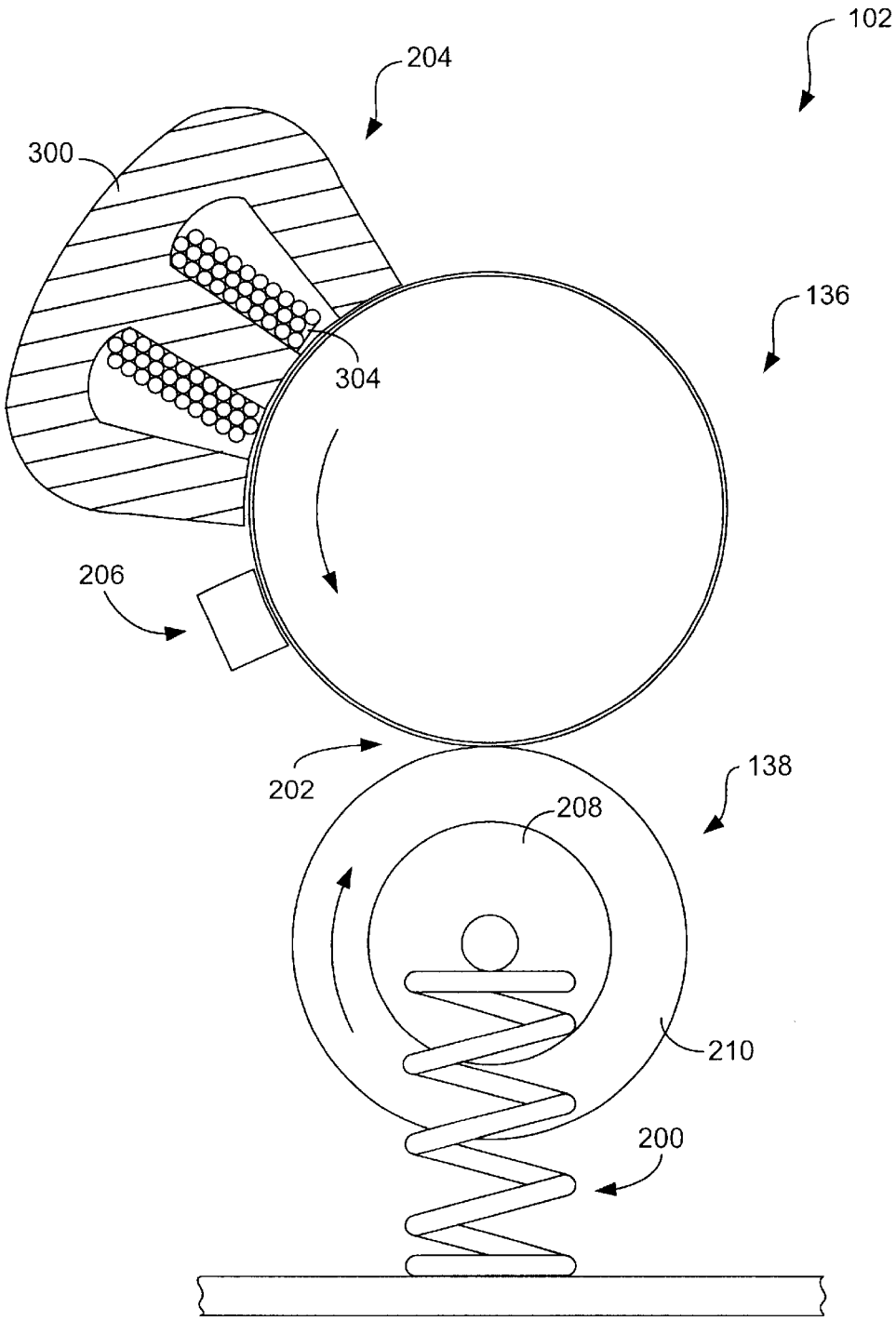
FIG. 2 is a partial cross-sectional end view of the fusing system shown in FIG. 1.

FIG. 2 illustrates a simplified end view of the fusing system 102 shown in FIG. 1. As indicated in FIG. 2, the fusing system 102 generally comprises the fuser roller 136, the pressure roller 138, a biasing element 200 typically comprising one or more springs that urge the pressure roller against the fuser roller to form a nip 202 therebetween, an external induction heating element 204, and a temperature sensor 206. The fuser roller 136 is formed as a hollow tube. In one preferred arrangement, the fuser roller 136 comprises a high temperature polymeric tube having an electrolessly plated metal layer (not visible in FIG. 2) that coats the inner surfaces of the roller. By way of example, the polymeric tube can be composed of polyimide and have a thickness of approximately 120 microns. The use of polyimide for the construction of the polymeric tube is advantageous because it is strong, extremely temperature resistant, and can be formed so as to result in a non-stick outer surface to which toner does not easily adhere. To enhance the non-stick attributes of the polymeric tube, a layer of TEFLON™ (polytetrafluoroethylene) (not visible in FIG. 2) can be applied to the outer surface of the tube, for instance having a thickness of approximately 1.5 to 2 mils.

By way of example, the metal layer can comprise a nickel layer that is formed on the inner surfaces of the polymeric tube through a chemical deposition process. The use of nickel is advantageous in that it is a ferromagnetic material having an extremely high saturation flux. As is known in the art, saturation flux is a quantification of the magnetic flux at which a material magnetically saturates. Beyond this flux, the material behaves as air and, therefore, can maintain no further eddy currents. When the material has a high saturation flux, the material will permit the formation of high eddy currents and therefore the generation of greater amounts of heat. Although nickel is considered a preferred material, it will be understood that other metals could be used, particularly other ferromagnetic metals. The metal layer can have a thickness of approximately 80 to 100 microns. Such small dimensions ensure beneficial heating characteristics. Specifically, the metal layer is thin enough to be heated very quickly, yet has enough thermal storage capacity to adequately transfer energy into the recording medium (e.g., piece of paper).

In a second preferred arrangement, the fuser roller 136 comprises a thin metal tube having a coating of an elastomeric material formed on its exterior surfaces such as silicon rubber or a flexible thermoplastic (not visible in FIG. 2). By way of example, the tube can comprise a steam-rated copper or aluminum pipe having a thickness of approximately 3 millimeters (mm). As will be appreciated by persons having ordinary skill in the art, the metal tube may or may not require the coating of elastomeric material. When it is used, however, the coating can have a thickness of approximately 100 mils or less. Although particular arrangements have been described for the construction of the fuser roller 136, it is to be understood that the particular configuration of the roller is less important than the fact that the roller comprises a relatively thin metal layer, either in the form of a coating or tube. As is described below, the metal layer facilitates the formation of eddy currents that flow within the layer in response to a magnetic flux applied by the external induction heating element 204. The flow of eddy currents generates the heat that is used to fuse toner to the recording medium.

The pressure roller 138 can comprise a metal shaft 208, e.g. made of stainless steel, that is surrounded by a layer 210 of elastomeric material such as silicon rubber or a flexible thermoplastic. By way of example, the layer 210 of elastomeric material can have a thickness of approximately 4 mm. As with the fuser roller 136, it is to be understood that the particular configuration of the pressure roller 138 is not critical to the present invention. As will be appreciated by persons having ordinary skill in the art, the materials and dimensions used for the construction of both the fuser roller 136 and pressure roller 138 can be varied to obtain the desired fusing characteristics in the nip 202. Indeed, as a general proposition, proper fusing can be attained by balancing considerations as to heat, pressure, and the time within the nip 202.

The temperature sensor 206 typically comprises a thermistor that is placed in close proximity to or in contact with the fuser roller 136 at a position adjacent the entry of the nip 202. Although this placement is preferred, it will be appreciated that other placement is also feasible. In an alternative arrangement, the sensor 206 can comprise a non-contact thermopile (not shown). Although non-contact thermopiles are preferable from the standpoint of reliability, they are more expensive and therefore increase the cost of the device 100.

With further reference to FIG. 2, the external induction heating element 204 is positioned in close proximity to the fuser roller 136. By way of example, the heating element 204 is placed at the ten o'clock position so as to provide space for the temperature sensor 206 without appreciably increasing the height of the fusing system 100. The heating element 204 is shown in greater detail in FIG. 3 which provides an exploded cross-sectional view of the element. As indicated in this figure, the external induction heating element generally comprises a pole member 300, an insulation layer 302, and a coil 304. The pole member 300 preferably is composed of a sintered ferrite material and, in the first embodiment, has a substantially E-shaped cross-section formed by a base 306, a central pole 308, and opposed flux concentrators 310.

Figure 3:
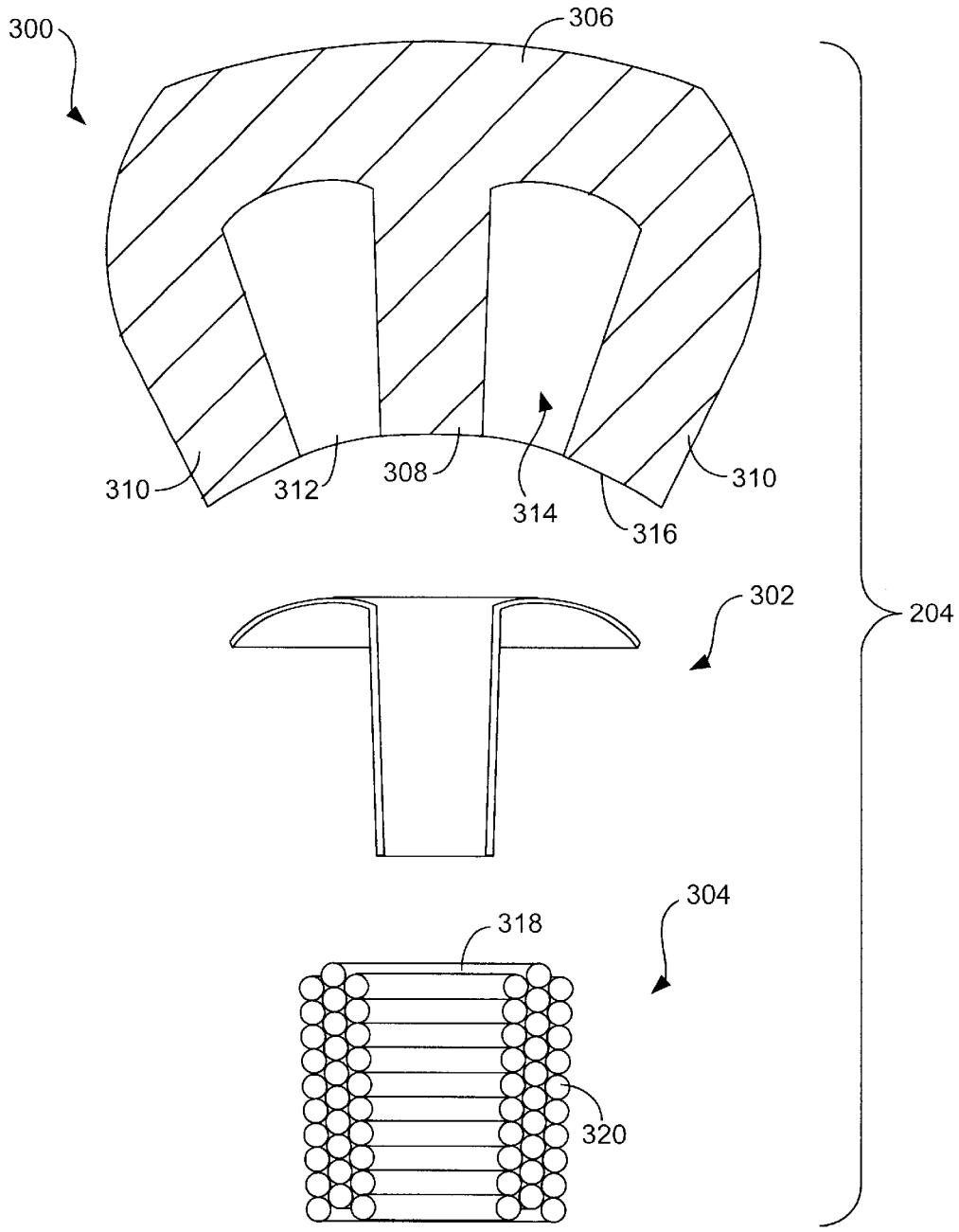
FIG. 3 is a cross-sectional, exploded end view of an induction heating element of the fusing system shown in FIG. 2.
Figure 4:
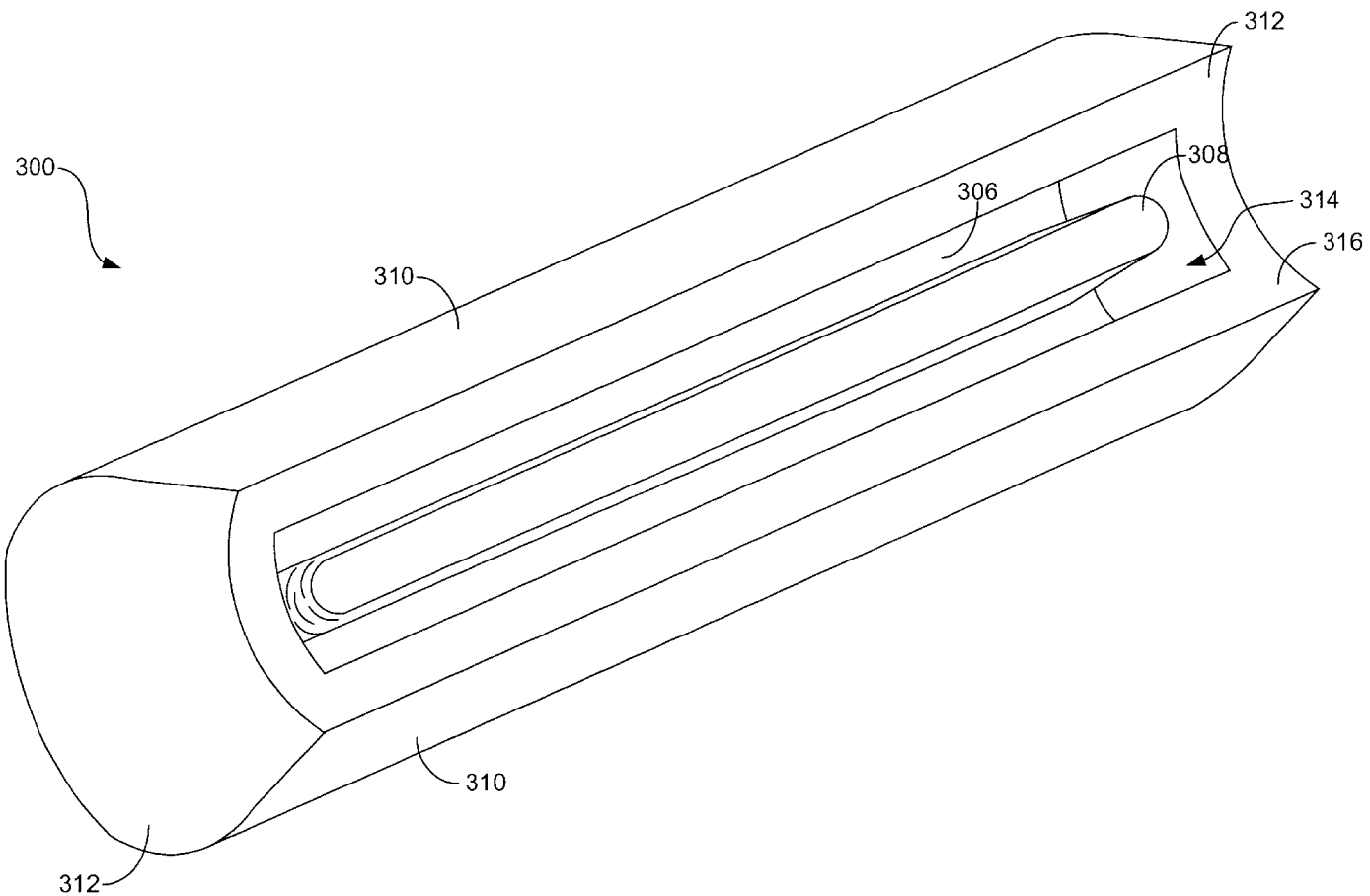
FIG. 4 is a perspective view of a pole member of the fusing system shown in FIG. 2.

As indicated most clearly in the perspective view of FIG. 4, the pole member 300 further includes end walls 312 that, together with the central pole 308 and flux concentrators 310, define an internal space 314 that permits the insertion of the coil 304 within the pole member (FIG. 2). Typically, the flux concentrators 310 terminate at the end walls 312, while the central pole 308 does not such that the interior space 314 is arranged as a continuous path that surrounds the central pole. As is apparent in both FIGS. 3 and 4, the central pole 308, flux concentrators 310, and end walls 312 together form a concave surface 316 that preferably has a radius of curvature that closely approximates the radius of the fuser roller 136 such that a very small gap, e.g. between approximately 1 and 2 mm in width, is formed between the external induction heating element 204 and the fuser roller (FIG. 2).

With reference to FIG. 3, the coil 304 comprises a plurality of turns 318 of a continuous conductive wire 320. In a preferred arrangement, the wire 320 comprises a copper Litz wire. As known in the electrical arts, Litz wires comprise a plurality of strands of relatively small wires that are braided together. Such an arrangement decreases the negative influence of the skin effect in which, in high frequency applications, current flowing through a wire tends to be concentrated in the outer surface of the wire, thereby increasing resistance and producing undesired heating of the wire. When a Litz wire is used, the wire can for instance comprise approximately twenty to thirty 30 gauge wire strands that provide a total cross-sectional area roughly equivalent to that of a 14 gauge wire.

The insulation layer 302 electrically insulates the coil 304 from the pole member 300 and vice versa. In addition, the insulation layer 302 reduces vibrations that arise in response to torques induced between the coil 304 and the pole member 300 during operation. The insulation layer 302 can be composed of substantially any electrically non-conductive material. Preferred, however, is one or more wrappings of polyimide tape or a formed polyimide member due to the high temperature and abrasion resistance of polyimide materials. The insulation layer 302 is interposed between the coil 304 and pole member 300 such that the coil can be wrapped around the central pole 308 with no direct contact made between the coil and pole member.

Operation of the fusing system 102 will now be described with reference to FIGS. 1–4. High frequency, e.g. approximately 10 kHz to 100 kHz, current is delivered by the power control circuit 150 to the coil 304. As the current flows through the coil 304, high frequency magnetic fluxes are generated in the central pole 308 of the external induction heating element 204. Due to the arrangement of the external induction heating element 204 and the fuser roller 136, the magnetic fluxes are focused upon the fuser roller and, therefore, upon the metal layer of the fuser roller. Notably, due to the provision of the flux concentrators 310, little magnetic flux is lost. If not for the provision of these concentrators 310, there would be significant magnetic flux leakage that would both reduce the efficiency of the fusing system 102 and risk the undesired heating of other metal components within the electrophotographic imaging device 100. The magnetic fluxes travel inside the metal layer of the fuser roller 136 and cause the metal layer to produce induced eddy currents that generate heat by the skin resistance of the metal layer, thereby heating the fuser roller. Preferably, enough heat is generated within the metal layer such that the exterior surfaces of the fuser roller 136 will have a fusing temperature of approximately 180° C. to 190° C. In most applications, this temperature is high enough to adequately melt the toner and flash the moisture out of the recording medium.

Figure 5:
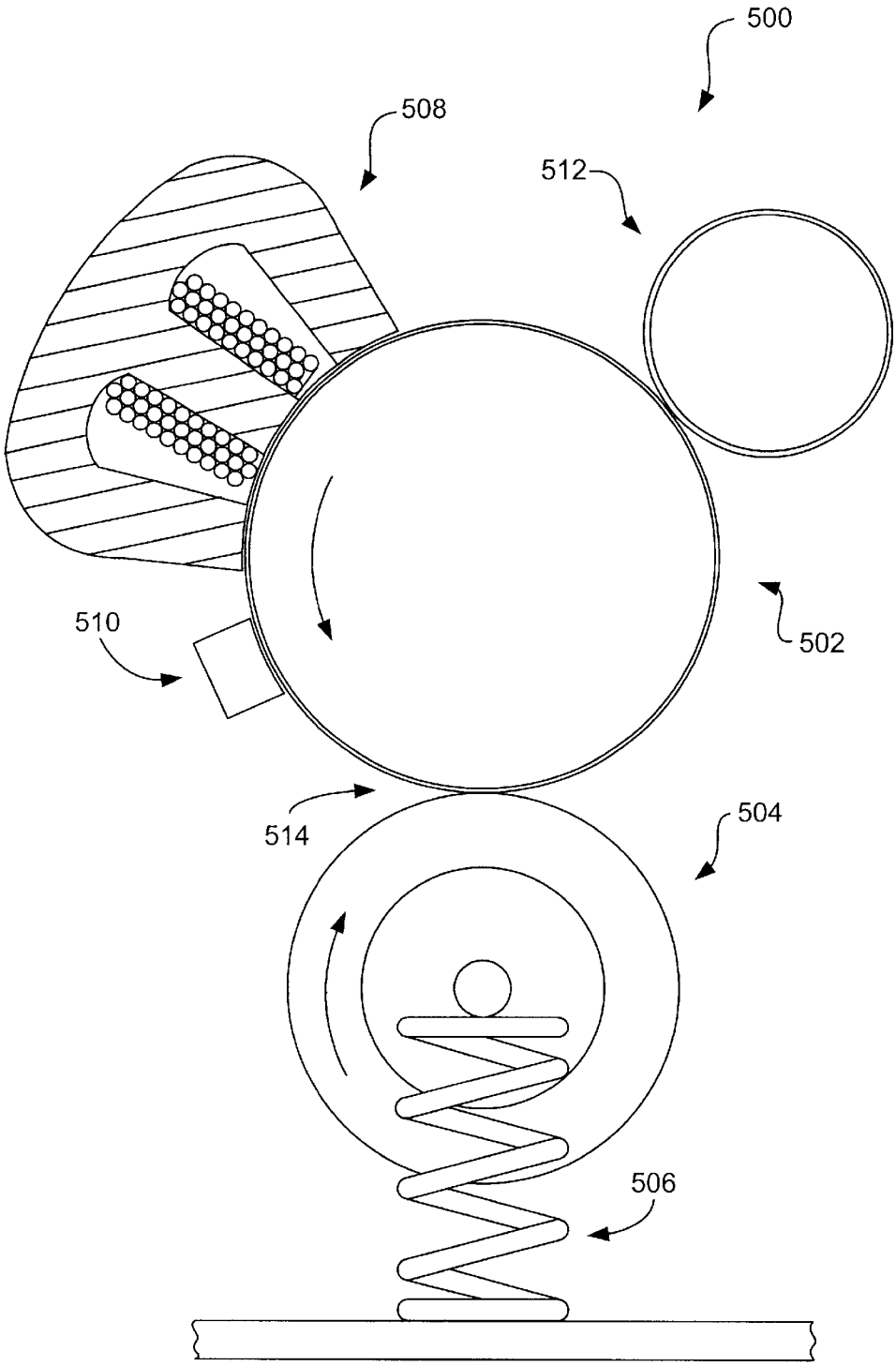
FIG. 5 is a partial cross-sectional end view of a second fusing system.

FIG. 5 illustrates a second fusing system 500. As indicated in this figure, the fusing system 500 is similar in construction to the fusing system 102 shown in FIG. 2. Accordingly, the fusing system 500 generally comprises a fuser roller 502, a pressure roller 504, a biasing element 506, an external induction heating element 508, and a temperature sensor 510, each of similar construction to the like-named components discussed above. In addition, however, the fusing system 500 includes a heat distribution roller 512 that contacts the fuser roller 502, for instance, at the two o'clock position. By way of example, the heat distribution roller 512 comprises a thin-walled tube composed of a thermally conductive material such as copper or aluminum. The tube can optionally be coated with a thin layer of TEFLON™ (polytetrafluoroethylene). Due to the high thermal conductivity of the heat distribution roller 512, the roller distributes heat across the length (into the page in FIG. 5) of the fuser roller 502 to reduce the potential for the formation of large heat gradients across the fuser roller nip 514 of the fusing system 500. Such heat gradients are generated when a relatively narrow recording medium such as an envelope is passed through the nip 514 of the fusing system 500 and can degrade the elastomeric materials of the fusing system.

Figure 6:
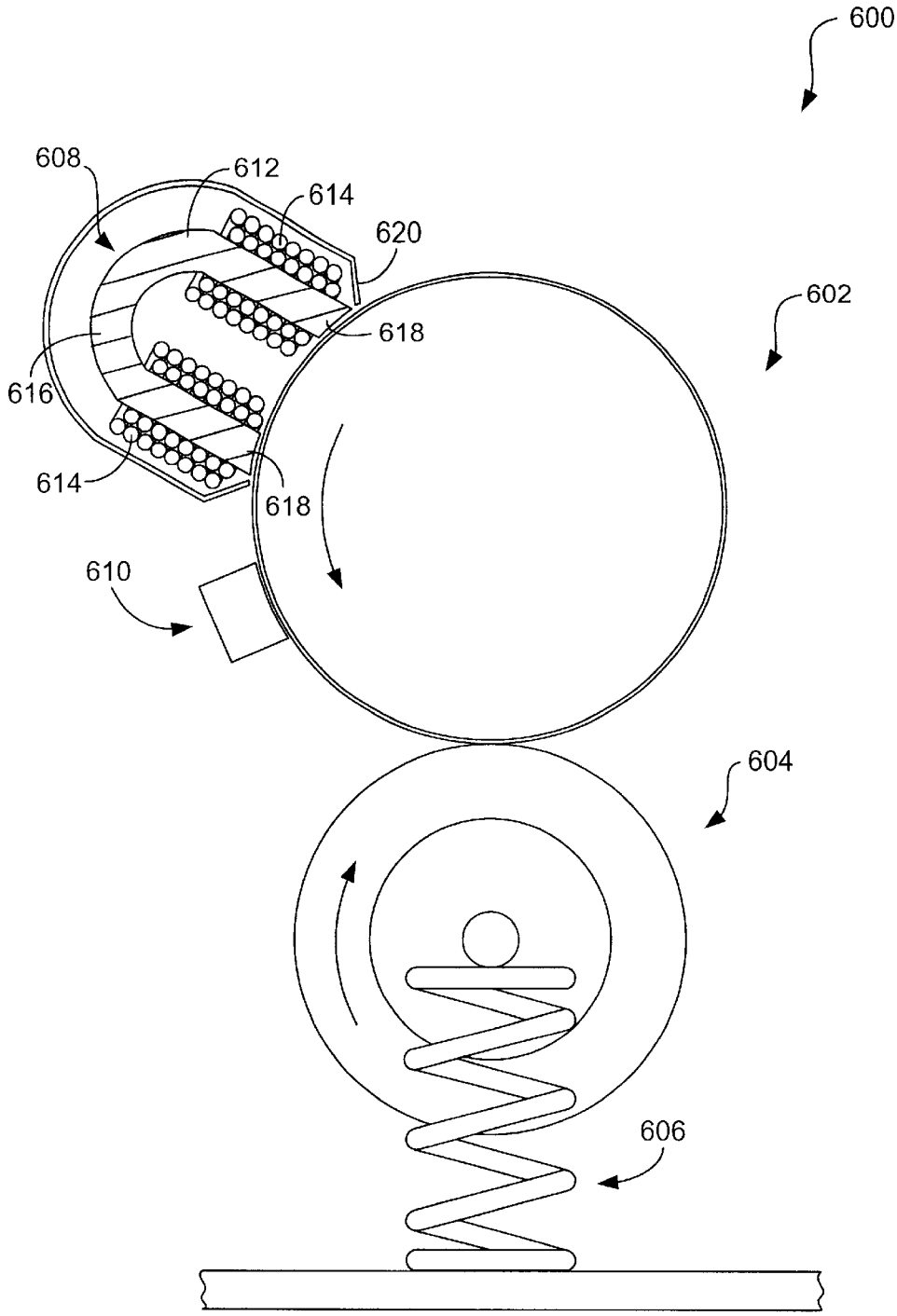
FIG. 6 is a partial cross-sectional end view of a third fusing system.

FIG. 6 illustrates a third fusing system 600. Again, this fusing system 600 is similar to the fusing system 102 shown in FIG. 2 and therefore includes a fuser roller 602, a pressure roller 604, a biasing element 606, an external induction heating element 608, and a temperature sensor 610. In this embodiment, however, the external induction heating element 608 has a generally U-shaped cross-section. As indicated in FIG. 6, the external induction heating element 608 comprises a pole member 612 and two coils 614. The pole member comprises a base 616 and two poles 618 that extend outwardly from the base. One coil 614 is wrapped around each pole 618 with a layer of insulation material (not shown) interposed therebetween. Each pole 618 terminates in a concave surface that has a radius of curvature that closely approximates the radius of the fuser roller 602. Surrounding the external induction heating element 608 is a electromagnetic shield 620 that contains any stray high frequency magnetic flux from the induction coil and prevents it from inadvertently heating other metal components of the print engine or inducing electromagnetic noise in various electrical systems. By way of example, the shield 620 can comprise an approximately 0.02 inch thick aluminum plate.

The fusing system 600 shown in FIG. 6 operates in similar manner to that shown in FIG. 2. Therefore, high frequency current flows through the coils 614 to generate high frequency magnetic fluxes in the poles 618. The magnetic fluxes are focused by the poles 618 upon the fuser roller 602 to cause the metal layer of the roller to produce eddy currents that generate heat within the roller.

While particular embodiments of the invention have been disclosed in detail in the foregoing description and drawings for purposes of example, it will be understood by those skilled in the art that variations and modifications thereof can be made without departing from the scope of the invention as set forth in the following claims.

What is claimed is:

1. A fusing system for fusing toner to a recording medium, comprising:

a fuser roller including a metal layer;

a pressure roller in contact with the fuser roller; and an induction heating element external to the fuser roller, the heating element operatively coupled to the metal layer of the fuser roller and including two poles and two coils, one coil wrapped around each pole.

2. The system of claim 1, wherein the fuser roller comprises a polymeric tube having a layer of metal deposited on its inner surfaces.

3. The system of claim 2, wherein the metal comprises a ferromagnetic metal.

4. The system of claim 2, wherein the metal comprises nickel.

5. The system of claim 1, wherein the metal layer comprises a metal tube of the fuser roller.

6. The system of claim 5, wherein the metal tube is coated with a layer of elastomeric material.

7. The system of claim 1, wherein the coils comprise Litz wires.

8. The system of claim 1, further comprising an electromagnetic shield that contains stray magnetic flux from the induction coils.

9. The system of claim 1, further comprising a heat distribution roller in contact with the fuser roller.

10. A device in which toner is fused to a recording medium, comprising:

means for attracting toner to a surface of the recording medium; and a fusing system including a fuser roller including a metal layer, a pressure roller in contact with the fuser roller, and an induction heating element external to the fuser roller and including two poles and two coils, one coil wrapped around each pole.

11. The system of claim 10, further comprising an electromagnetic shield that concentrates magnetic flux on the fuser roller.

* * * * *